US005630781A

United States Patent [19]

Hubbard

[11] Patent Number: 5,630,781

[45] Date of Patent: May 20, 1997

[54] PAPER AIRPLANE FOLDING DEVICE

[76] Inventor: Dennis Hubbard, 229 Chapin St., Chadron, Nebr. 69337

[21] Appl. No.: 361,387

[22] Filed: Dec. 22, 1994

[51] Int. Cl.[6] ..... B31F 7/00

[52] U.S. Cl. ..... 493/438; 493/446; 493/959

[58] Field of Search ..... 493/405, 416, 493/436, 438, 446, 447, 455, 456, 959

[56] References Cited

U.S. PATENT DOCUMENTS

| | | | |
|---|---|---|---|
| 329,173 | 10/1885 | Jehle . | |
| 1,001,443 | 8/1911 | Graf | 493/455 |
| 1,201,719 | 10/1916 | Groff . | |
| 1,371,349 | 3/1921 | Brownlow . | |
| 1,858,621 | 5/1932 | Gunn | 493/456 |
| 1,999,314 | 4/1935 | Anderson | 493/959 |
| 2,344,693 | 3/1944 | Gade | 493/959 |
| 2,676,797 | 4/1954 | Mills | 493/455 |
| 2,712,933 | 7/1955 | Davidson | 493/455 |
| 2,890,044 | 6/1959 | Wisdom | 270/79 |
| 3,361,425 | 1/1968 | Benitez | 270/86 |
| 4,012,865 | 3/1977 | Fields | 46/79 |
| 4,014,251 | 3/1977 | Meyer | 93/1 R |
| 4,103,454 | 8/1978 | Stone | 46/79 |
| 4,209,937 | 7/1980 | Witte | 46/81 |
| 4,329,808 | 5/1982 | Rich et al. | 46/81 |
| 4,468,020 | 8/1984 | Wallace | 493/447 |
| 4,579,552 | 4/1986 | Brannlund | 493/439 |
| 5,100,357 | 3/1992 | MacCready | 446/61 |
| 5,162,010 | 11/1992 | Krebs | 446/112 |
| 5,326,301 | 7/1994 | Woodside | 446/176 |
| 5,334,068 | 8/1994 | Davis | 446/34 |

*Primary Examiner*—Joseph J. Hail, III
*Assistant Examiner*—Christopher W. Day
*Attorney, Agent, or Firm*—Fay, Sharpe, Beall, Fagan, Minnich & McKee

[57] ABSTRACT

The present invention relates to a device for folding a sheet of paper into an aerodynamic configuration. The device can be described as a forming implement with a plurality of wing and tail folding surfaces. The device includes an entrance end and an exit end and is adapted to have a sheet of material passes therethrough. In use, as the sheet of material is passed through the device it attains an aerodynamic configuration. In the preferred embodiment of the present invention, the wing and tail folding surfaces are resiliently mounted to the device. Furthermore, the device includes a means for delivering the sheet of material from the entrance to the exit end of device.

8 Claims, 5 Drawing Sheets

PAPER AIRPLANE FOLDING DEVICE

BACKGROUND OF THE INVENTION

1. Field of the Invention

The present invention relates to a device for use in folding a sheet of material into an aerodynamic configuration, and more specifically relates to a folding implement having a number of forming surfaces which is adapted to have a sheet of material passed therethrough. The present invention also relates to a kit for use in assembling the described device and a method of using the described device.

2. Description of the Related Art

Devices for use in folding cloth and/or paper are known in the prior art. Specifically, U.S. Pat. No. 1,371,349 to Brownlow and U.S. Pat. No. 3,361,425 to Benitez each disclose devices for use in folding paper napkins. Likewise U.S. Pat. No. 1,201,719 to Groff discloses a paper folding machine for use in folding paper serviettes such as those used in restaurants. Furthermore, U.S. Pat. No. 4,579,552 to Brannlund discloses a device for use in crimping sheet rock tape, and U.S. Pat. No. 329,173 to Jehle discloses a former for a paper bag. Thus, all of these devices broadly relate to forming or folding materials. However, none of these devices even remotely relates to folding a sheet of material into an aerodynamic configuration as is the subject of the present invention. U.S. Pat. No. 4,329,808 to Rich et al. relates to a paper-airplane-making and launching device. As such, the device of Rich immediately departs from the present invention in that it is not a dedicated device, i.e. it both makes and launches a paper airplane, unlike the present invention which is solely dedicated to forming a sheet of material into an aerodynamic configuration. Furthermore, the present invention is inherently different from the device of Rich, in that Rich employs a folder #30 which is swung into various positions to effect folding.

SUMMARY OF THE INVENTION

The present invention relates to a device having an entrance end and an exit end for use in forming a sheet of material into an aerodynamic configuration. The device includes a number of wing folding surfaces which are each resiliently mounted to the device. The device further includes a number of tail forming surfaces with each of the tail forming surfaces resiliently mounted to the devices. Additionally, the device of the present invention includes a means for delivering a sheet of material from the entrance end of the device to the exit end of the device such the sheet of material comes into contact with the wing folding surfaces and the tails forming surfaces. Furthermore, the present invention relates to kit for use in constructing the described device. Additionally, the present invention relates to a method of using the described, assembled device.

That having been described, it is an object of the present invention to provide a device for use in forming a sheet of material into a aerodynamic configuration.

Furthermore, it is an object of the present invention to provide such a device wherein a sheet of material attains an aerodynamic configuration by being pushed or pulled through the device.

It is an object of the present invention to provide an implement for use in pushing a sheet of material through the device of the present invention.

It is an object of the present invention to provide a kit for use in assembling the device of the present invention.

Lastly, it is an object of the present invention to describe a method for employing the device of the present invention.

DESCRIPTION OF THE PREFERRED EMBODIMENT

Figure 1:
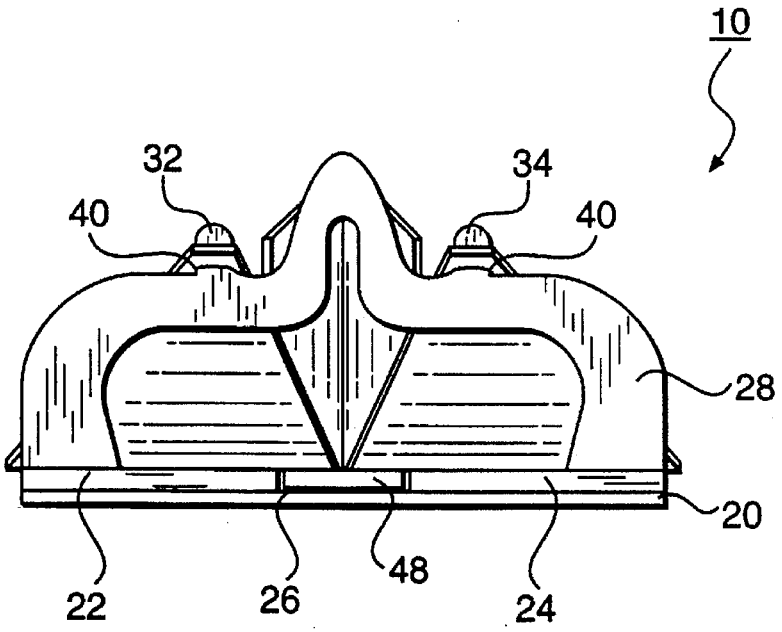
FIG. 1 is a front elevational view of the device for forming a sheet of material into an aerodynamic configuration.
Figure 2:
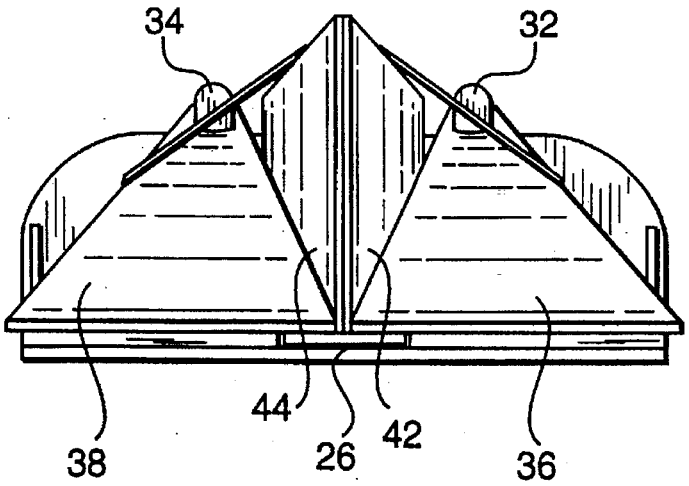
FIG. 2 is a rear elevational view of the device of FIG. 1
Figure 3:
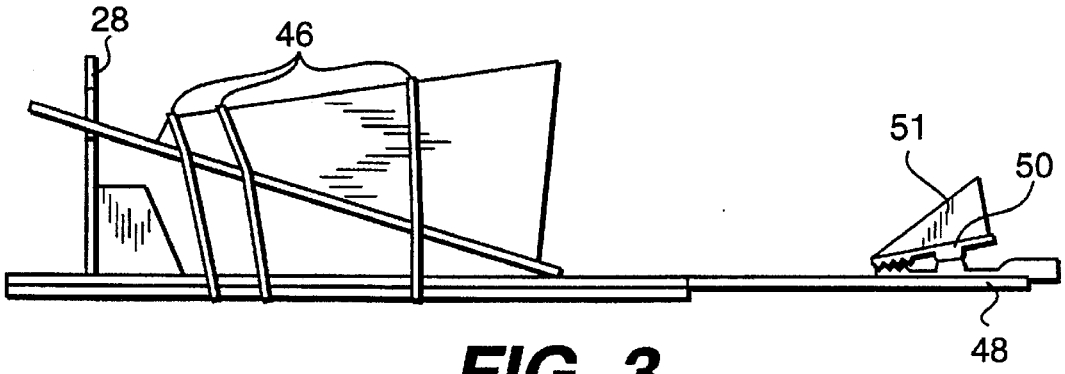
FIG. 3 is a side elevational view of the device of FIG. 1
Figure 4:
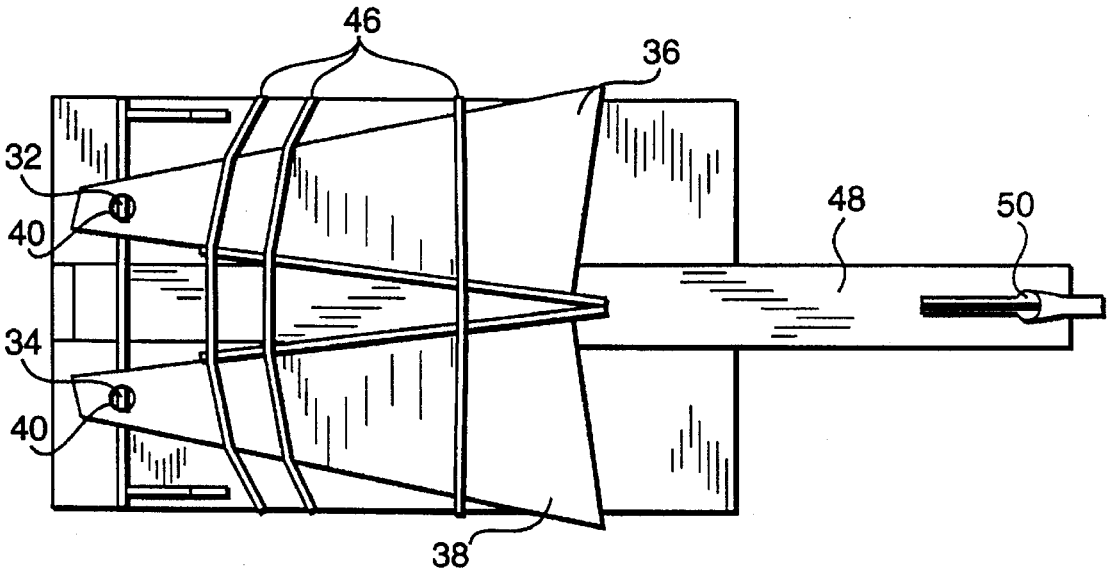
FIG. 4. is a plan view of the device of FIG. 1
Figure 5:
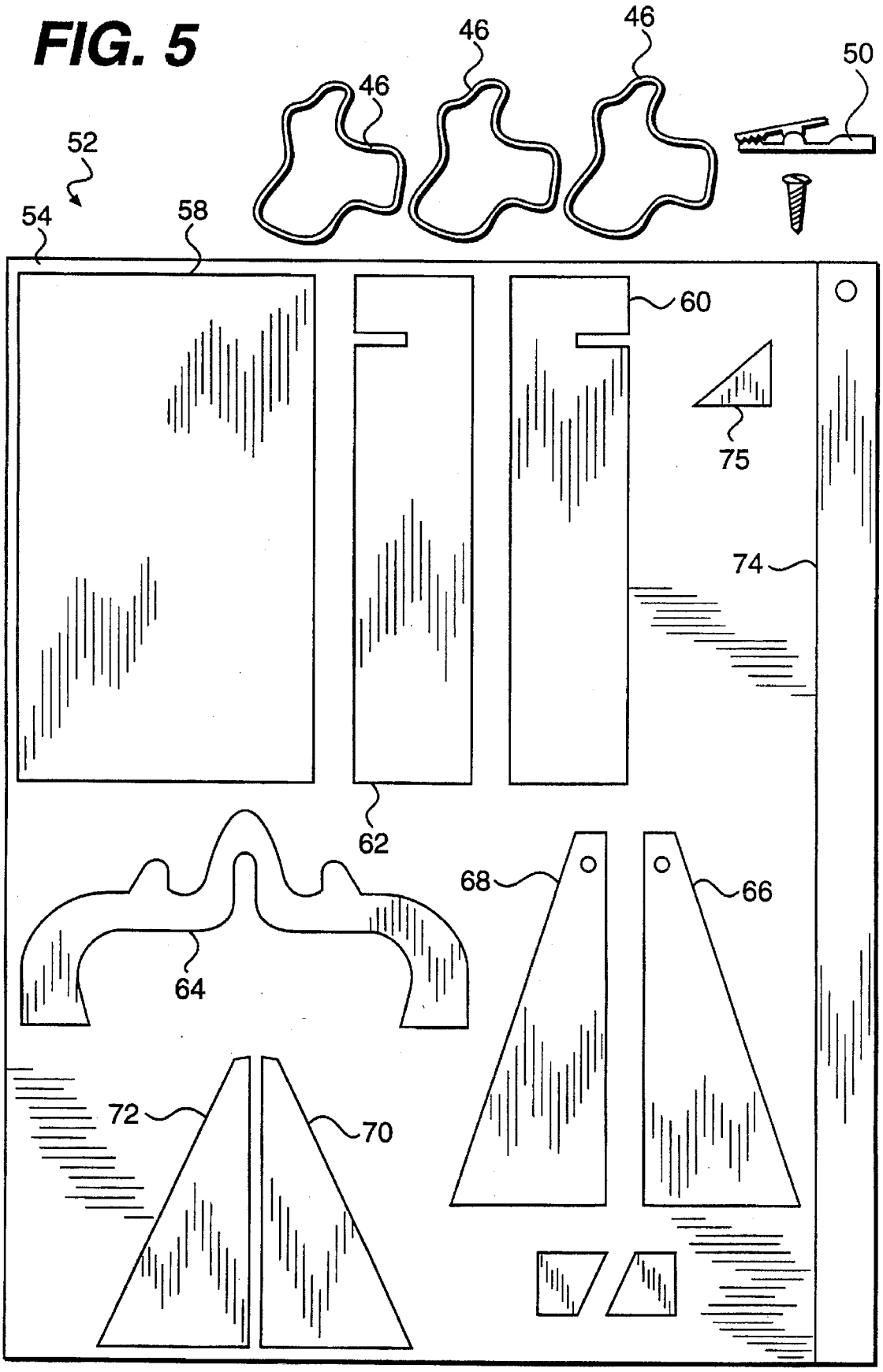
FIG. 5 is a view of the kit for use in assembling the device of the present invention.

The present invention relates to a device 10 for folding a sheet of paper into an aerodynamic configuration. The device can be described as a forming implement with a plurality of forming, shaping or folding surfaces. The device includes an entrance end and an exit end and is adapted to have a sheet of material passed therethrough. In use, as the sheet of material is passed through the device it attains an aerodynamic configuration. In the preferred embodiment of the present invention, the wing and tail folding surfaces are resiliently mounted to the device. Furthermore, the device includes a means for delivering the sheet of material from the entrance to the exit end of device. Details as to the various components of the present invention, and the manner in which they interrelate will be described in greater detail hereinafter in connection with the figures.

A substantially planar base member 20, having a forward end and a rearward end, forms the foundation of the device 10. Upon the base member 20 are secured first and second channel forming members 22 and 24. These channel forming members serve to define a centrally positioned channel 26 upon the top surface of the base member 20. The function of the channel 26 will be more fully described hereinafter.

A curved entrance member 28 serves as the initial folding member of the device. As well as being the initial folding member of the device, the entrance member 28 is a pivot point for other folding surfaces of the device and has a first side and a second side. As a result, two curved protrusions 32 and 34 are provided at the top portion of the entrance member 28. The manner in which the other folding surfaces relate to the protrusions will be described in greater detail hereinafter. The bottom portion of this curved entrance member is secured to the top surface of the base member 20. The securement between the base member 20 and the curved entrance member 28, as well as between any of the other members described for this device, can be achieved in any number of ways. In the preferred embodiment, the various components of the device are secured together by glue. The preferred material for the device is ⅛" lite plywood, therefore, any wood glue would be preferred. However, other woods can be use in constructing the device and other lightweight rigid materials would suffice as well.

First and second wing shaping members 36 and 38 are essential folding or forming surfaces for the device. Both the wing shaping members are triangular in configuration with a base portion, a top surface, a bottom surface and an apex portion. An aperture 40 is formed within the apex of each of the wing shaping members. These apertures are dimensioned to be positioned over the protrusions 32, 34 of the entrance member. In this manner each of the wing shaping members 36, 38 is pivotally secured to the entrance member 28. The base ends of each of the wing shaping members merely rest upon the top portion of the base member in order to facilitate the pivotal connection.

The device further includes first and second tail shaping members 42 and 44. Each of the tail shaping members is triangular in configuration with a base portion, an apex portion, a straight edge and a slanted edge. The straight edge of first tail shaping member is secured to the straight edge of the first wing shaping member, and likewise the straight edge of the second tail shaping member is secured to the straight edge of the second wing shaping member. These securements are such that each wing shaping member is positioned 90 degrees relative to its corresponding tail shaping member. Thus, the tail shaping members 42, 44 are pivotally connected to the entrance member 28 by way of the wing shaping members 36, 38. The first wing shaping member 36 and the first tail shaping member 42 together define a first wing/tail forming surface. Likewise, the second wing shaping member 38 and the second tail shaping member 44 together define a second wing/tail forming surface. A number of resilient elements 46 function to bias the wing/tail forming surfaces with respect to the entrance member 28. In the preferred embodiment, these resilient members 46 take the form of rubber bands which encircle the device 10.

A paper reaming element 48 is employed in delivering the sheet of material through the device. The paper reaming implement is an elongated piece of wood with a clip 50 secured upon one of its ends. A triangular guiding element 51, secured to the clip, facilitates the travel of the clip from the entrance to the exit end of the device. The reaming element 48 is of a width which allows it to be inserted within the channel 26 formed upon the upper surface of the base. Also, resilient members 46 permit movement of the wing and tail forming members so that clip 50 can pass through the device.

Figure 6:
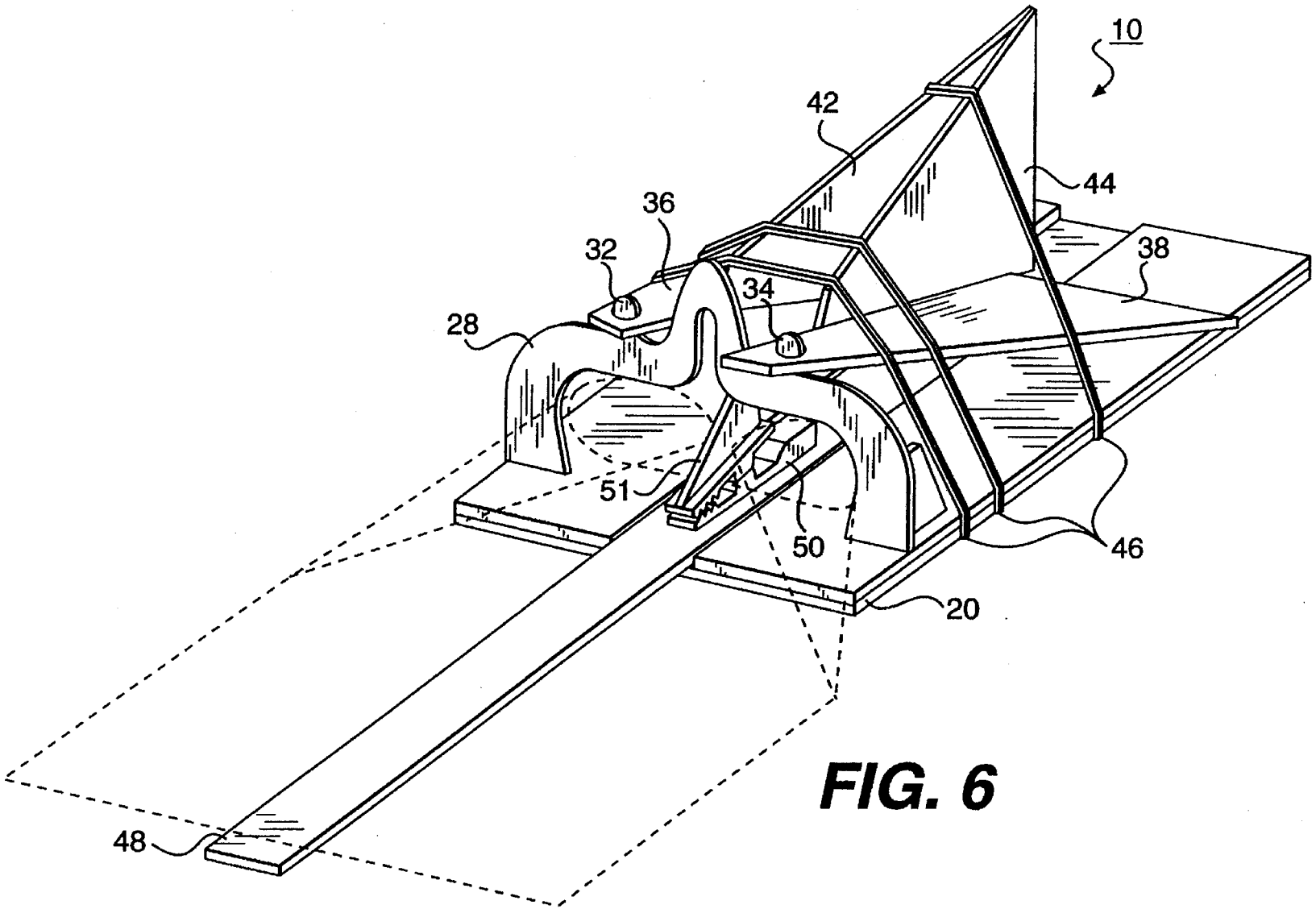
FIG. 6 is a front perspective view of the device.
Figure 7:
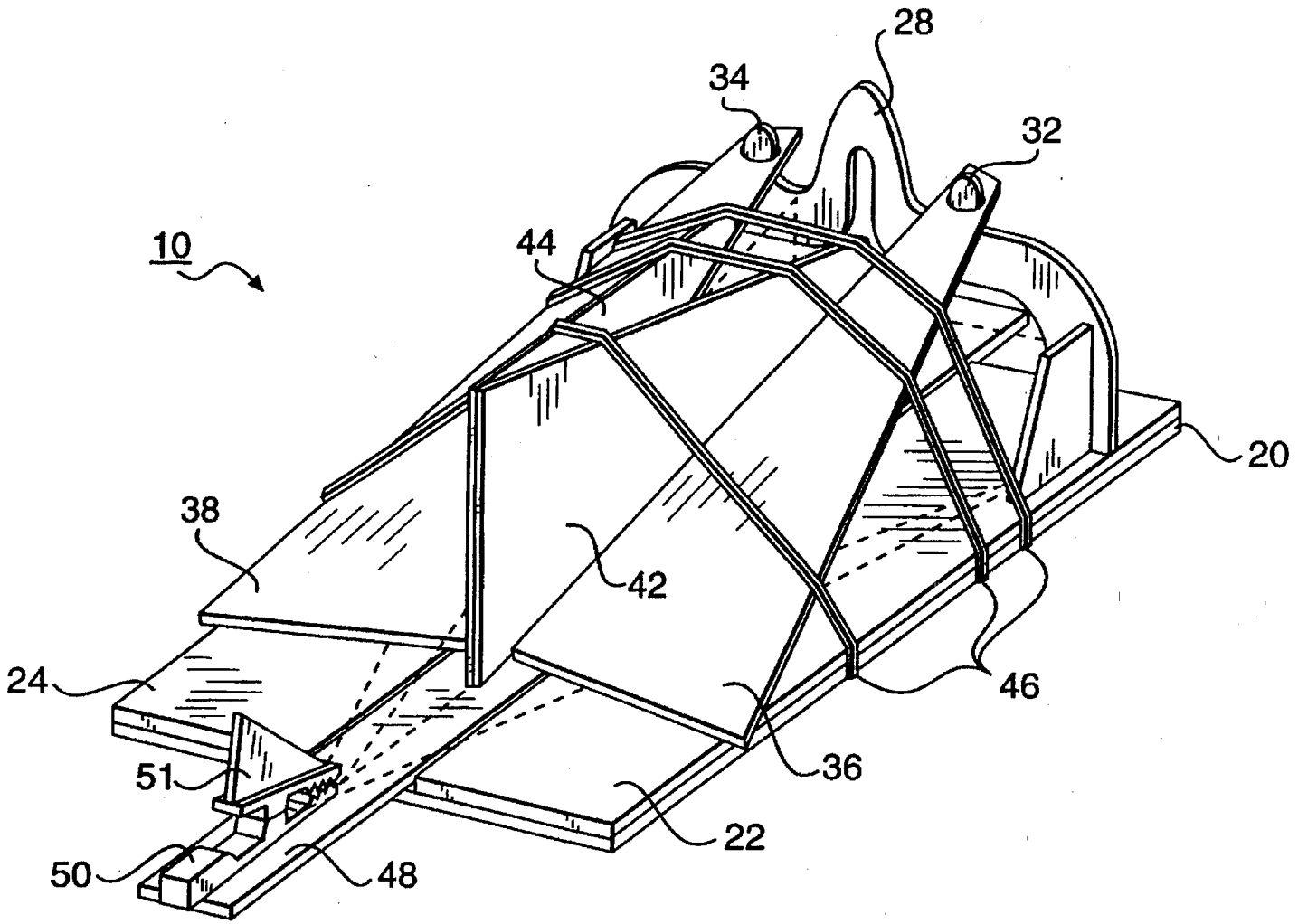
FIG. 7 is a rear perspective view of the device

In operation, a user would take the paper reaming implement 48, having a first end and a second end, and secure a piece of paper to it via the clip 50. The reaming implement would then be inserted within the channel 26 of the base 20 at the entrance end of the device 10. With the paper reaming implement 48 sliding along the channel 26, the paper would come into contact with the various forming members. Specifically, the paper would first come into contact with the curved entrance member 28, the first and second wing shaping members 36, 38, and then first and second tail shaping members 42, 44. FIG. 6 illustrates how the paper folds upon coming into contact with the curved entrance member 28. The rubber bands would keep each of the wing and tail forming members urged toward the base. As such, the wing and tail forming members would apply pressure to the paper. After the paper reaming implement is pushed approximately halfway through the device, it can be pulled from the exit end. FIG. 7 illustrates the reaming implement as it is being pulled through the device. The paper thus passed through the device would be in an aerodynamic configuration and ready to fly.

The present invention can also take the form of a kit 52, with the various components of the device unassembled. In this form a uniform sheet 54 of ⅛" lite plywood, or other rigid material, is provided. Additionally, a number of perforations, delineating the various components of the device, are provided within the sheet 54. These perforations are such that the various components can be easily punched out. Thus, in the preferred embodiment the following perforations are provided:

a first perforation 58 defining the base member 20; second 60 and third 62 perforations defining the first 22 and second 24 channel forming members respectively; a fourth perforation 64 defining the curved entrance member 28; fifth 66 and sixth 68 perforations defining the first 36 and second 38 wing shaping members respectively; seventh 70 and eighth 72 perforations defining the first 42 and second 44 tail shaping members respectively; and a ninth 74 perforation defining the elongated paper reaming implement 48; and a tenth perforation 75 defining the triangular guiding element 51. Once the various components are punched from the sheet they would be assembled in the manner previously described.

Thus, what has been described is a device 10 for forming a sheet of material into an aerodynamic configuration. Furthermore, a kit 52 has been described for use in constructing the described device. Additionally, the present invention relates to a method for forming a sheet of material into an aerodynamic configuration. This method including providing a device for use in forming the sheet of paper into an aerodynamic configuration. Providing means for delivering the sheet of material through the device. Securing the sheet of material to the means for delivering, pushing the means for delivering through the device, and lastly releasing the sheet of material from the means for delivering.

I claim:

1. A device for forming a sheet of paper into an aerodynamic configuration, the device having an entrance end and an exit end, the device comprising in combination:

a base member having a forward end, a rearward end, a top surface and a bottom surface, a channel formed centrally within said top surface of said base member;

a curved entrance member having a top portion and a bottom portion, a first side and a second side, said bottom portion of said curved entrance member being secured to said top surface of said base member;

a triangular first wing shaping member having a base portion and an apex portion, a top surface and a bottom surface, said apex of said first wing shaping member being secured to said first side of said curved entrance member, said base of said first wing shaping member resting upon said top surface of said base member;

a triangular second wing shaping member having a base portion and an apex portion, said apex of said second wing shaping member being secured to said second side of said curved entrance member, said base of said second wing shaping member resting upon said top surface of said base member;

a first triangular tail shaping member having a base portion and an apex portion, a straight edge and a slanted edge, said straight edge of said first triangular tail shaping member being secured to said first wing shaping member such that said first tail shaping member and said first wing shaping member form a 90° angle with respect to one another;

a second triangular tail shaping member having a base portion and an apex portion, a straight edge and a slanted edge, said straight edge of said second tail shaping member being secured to said second wing shaping member such that said second tail shaping member and said second wing shaping member form a 90° angle with respect to one another;

an elongated paper reaming implement having a first end and a second end, said second end of said paper reaming member having a clip secured thereon, said paper reaming implement adapted to be inserted within said channel upon said upper surface of said base member;

a plurality of resilient elements adapted to encircle the entire device and resiliently urge said first wing shaping member, said second wing shaping member, said first tail shaping member and said second tail shaping member towards said base member.

2. A device having an entrance end and an exit end for forming a sheet of material into an aerodynamic configuration, the device comprising in combination:

a number of wing folding surfaces, said wing folding surfaces being resiliently mounted to the device;

a number of tail folding surfaces, each of said tail folding surfaces being resiliently mounted to the device;

a means for delivering a sheet of material from the entrance end of the device to the exit end of the device such that the sheet of material comes into contact with said wing folding surfaces and said tail folding surfaces.

3. A device for forming a sheet of material into an aerodynamic configuration in accordance with claim 2 wherein:

each of said wing folding surfaces is triangular in shape and has a base end and an apex end, and furthermore where each of said wing folding surfaces is positioned at an angle with respect to the top surface of the base member.

4. A device for forming a sheet of material into an aerodynamic configuration in accordance with claim 2 wherein:

each of the tail folding surfaces is triangular in configuration and has a base portion and an apex portion; and each of said tail folding surfaces is rigidly secured to each of said wing folding surfaces.

5. A device for forming a sheet of material into an aerodynamic configuration in accordance to claim 2, further comprising:

a sheet reaming implement having a first end and a second end, said sheet reaming implement adapted to ream a sheet of material from the entrance end of the device to the exit end of the device such that a sheet of material may come into contact with, and be formed into an aerodynamic configuration thereby, said wing folding surfaces and said tail folding surfaces.

6. A kit for forming the device as described in claim 2, the kit comprising:

a planar sheet of a substantially rigid material having a number of perforations formed therein;

a number of perforations defining wing folding surfaces, said wing folding surfaces adapted to be resiliently secured to the device;

a number of perforations defining tail folding surfaces, said tail folding surfaces adapted to be secured to said wing folding surfaces;

a perforation defining means for delivering a sheet of material from the entrance end of the device to the exit end of the device.

7. A kit for constructing a device for forming a sheet of material into an aerodynamic configuration, the kit comprising:

a planar sheet of a substantially rigid material, said planar sheet of material having a number of members delineated therein by perforations;

a first perforation defining a base member having a forward end, a rearward end, a top surface and a bottom surface;

a second perforation defining a first channel forming member, said first channel forming member adapted to be secured to said top surface of said base member;

a third perforation defining a second channel forming member, said second channel forming member adapted to be secured to said top surface of said base member, said first and second channel forming members functioning to provide a channel on said top surface of base member when secured thereon;

a fourth perforation defining a curved entrance member having a top portion and a bottom portion, a first side and a second side, said bottom portion of said curved entrance member adapted to be secured to said top surface of said base member;

a fifth perforation defining a triangular first wing folding member having a base portion and an apex portion, a top surface and a bottom surface, said apex of said first wing folding member adapted to be secured to said first side of said curved entrance member, said base of said first wing folding member adapted to rest upon said top portion of said base member;

a sixth perforation defining a triangular second wing folding member having a base portion and an apex portion, a top surface and a bottom surface, said apex of said second wing folding member adapted to be secured to said second side of said curved entrance member, said base of said second wing folding member adapted to rest upon said top portion of said base member;

a seventh perforation defining a first triangular tail folding member having a base portion and an apex portion, a straight edge and a slanted edge, said straight edge of said first triangular tail folding member adapted to be secured to said first wing folding member such that said first tail folding member and said first wing folding member form a 90° angle with respect to one another;

an eighth perforation defining a second triangular tail folding member having a base portion and an apex portion, a straight edge and a slanted edge, said straight edge of said second triangular tail folding member adapted to be secured to said second wing folding member such that said second tail folding member and said second wing folding member form a 90° angle with respect to one another;

a ninth perforation defining an elongated paper reaming implement having a first end and a second end, said second end of said paper reaming member adapted to have a clip secured thereon, said paper reaming implement adapted to be inserted within said channel upon said upper surface of said base member.

8. A method for forming a sheet of paper into an aerodynamic configuration, the method comprising the steps of:

providing a device for use in forming the sheet of paper into an aerodynamic configuration, said device having an entrance end and an exit end, said device including a number of wing folding surfaces and a number of tail folding surfaces;

providing a means for delivering the sheet of material from said entrance end of the device to said exit end of the device;

securing the sheet of material to said means for delivering;

pushing said means for delivering and the sheet from said entrance end of said device to said exit end of said device;

releasing the sheet of material from said means for delivering.

* * * * *